US006422436B1

(12) United States Patent
Mills

(10) Patent No.: US 6,422,436 B1
(45) Date of Patent: Jul. 23, 2002

(54) REFRACTORY NOZZLE

(76) Inventor: Stephen David Mills, 9 Gypsy Lane, Marton, Middlesbrough TS7 8NF (GB)

( * ) Notice: Subject to any disclaimer, the term of this patent is extended or adjusted under 35 U.S.C. 154(b) by 0 days.

(21) Appl. No.: 09/530,696

(22) PCT Filed: Sep. 1, 1999

(86) PCT No.: PCT/GB99/02877

§ 371 (c)(1),
(2), (4) Date: Jun. 22, 2000

(87) PCT Pub. No.: WO00/13822

PCT Pub. Date: Mar. 16, 2000

(30) Foreign Application Priority Data

Sep. 4, 1998 (GB) ..... 9819191

(51) Int. Cl.[7] ..... B22D 41/08
(52) U.S. Cl. ..... 222/606; 222/597; 222/591
(58) Field of Search ..... 222/591, 594, 222/597, 600, 606; 266/236

(56) References Cited

U.S. PATENT DOCUMENTS 4,037,762 A * 7/1977 Ruckstuhl ..... 222/591
4,042,207 A * 8/1977 Nehrlich et al. ..... 222/600
4,051,589 A * 10/1977 Tinnes ..... 222/600
5,044,533 A 9/1991 King
5,173,199 A * 12/1992 Bruckner et al. ..... 222/600
5,310,164 A * 5/1994 Rothfuss et al. ..... 222/594
5,397,105 A 3/1995 Soofi
5,718,415 A * 2/1998 Dainton ..... 222/597
5,766,543 A * 6/1998 Dainton ..... 222/594

FOREIGN PATENT DOCUMENTS

EP 0 388 387 A 9/1990
FR 2 332 831 A 6/1977

* cited by examiner

*Primary Examiner*—Scott Kastler
(74) *Attorney, Agent, or Firm*—Lahive & Cockfield, LLP

(57) ABSTRACT

A refractory nozzle is provided having upper and lower members. According to an embodiment of the invention, the upper member has an axial passage having a mouth at a top end and an enlarged diameter section at its bottom end. The lower member has a top fitting into the enlarged diameter section of the upper member and a tapered bore, tapered throughout its length, matching a bottom of the axial passage of the upper member.

11 Claims, 2 Drawing Sheets

REFRACTORY NOZZLE

This invention relates to a refractory nozzle for use with a metallurgical vessel such as a bottom pour ladle or a casting box.

In foundries devices such as bottom pour ladles, casting boxes and the like are used extensively to pour molten metal into moulds; these devices, which will hereinafter be referred to simply as ladles are provided with a refractory nozzle in their bottom. The flow of molten metal through the nozzle is controlled by a refractory stopper in the interior of the ladle, the stopper being moved into and out of the nozzle aperture.

For a given mould, there is a correct nozzle outlet diameter and only a small range of suitable flow rates of metal into the mould as too great a flow rate can damage the mould while too slow a flow rate results in an unsatisfactory casting. The maximum rate of flow of the metal through the nozzle is determined by the outlet diameter of the nozzle and the depth or ferrostatic head of metal in the ladle, and lessens as the head of metal decreases. Thus problems can arise when, as is common, a number of different moulds have to be poured from a single ladle as if the flow rate is appropriate for the first mould then it is too small for later moulds.

A commonly adopted solution to this problem is to use a nozzle that is oversize for the initial pourings and to control the flow by means of the stopper. This practice is not entirely satisfactory as the use of oversize nozzles tends to produce unsatisfactory castings as does undue throttling of the metal flow by the stopper.

It is an object of the present invention to obviate or mitigate these problems.

The present invention is refractory nozzle comprising upper and lower members, the upper member having an axial passage comprising a mouth at its top end, a tapered bore, and an enlarged diameter section at its bottom end, and the lower member having a top fitting into the enlarged section, and a tapered bore the top end of which matches the bottom of the tapered bore of the upper member.

The present invention is also a bottom pour metallurgical vessel having a hole in its bottom, a nozzle as defined in the last preceding paragraph and means for securing the nozzle in position in the hole.

BRIEF DESCRIPTION OF THE DRAWINGS

An embodiment of the present invention will now be described, by way of example, with reference to the accompanying drawings in which:

Referring now to FIG. 1, a metallurgical vessel, in this embodiment a bottom pour ladle 10, comprises an outer steel shell 12 with a lining 14 of a refractory material. In the bottom of the ladle is provided a hole 16 through both the lining 14 and the shell 12, the hole 16 increasing in diameter as it passes from the inside of the lining 14 to the outside of the shell 12. The hole 16 is provided to locate a nozzle through which the contents of the ladle 10 can be discharged. Associated with the ladle is a refractory stopper 18. The ladle 10, as so far described, is essentially a standard item.

Figure 1:
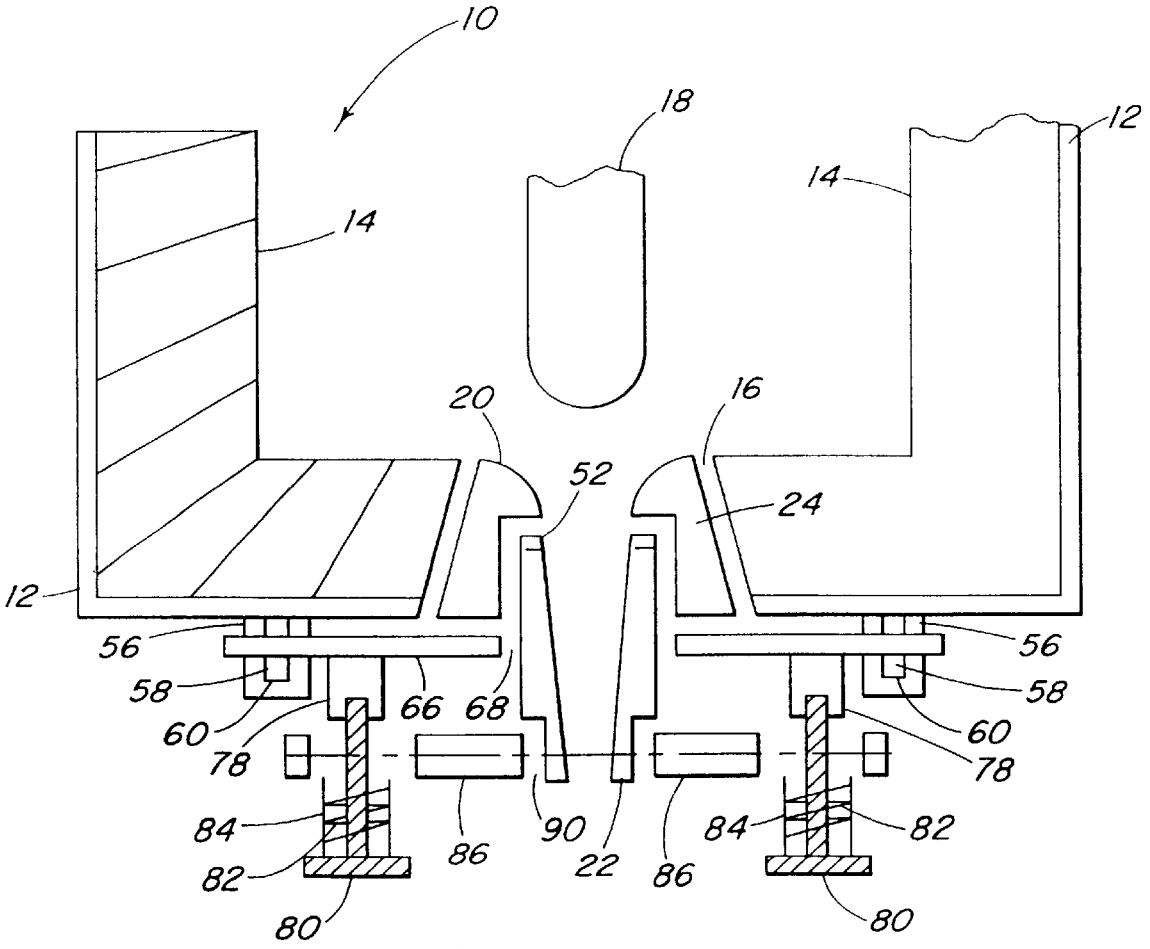
FIG. 1 is a cross-sectional view through the bottom of a bottom pour ladle having a refractory nozzle according to the present invention.
Figure 2:
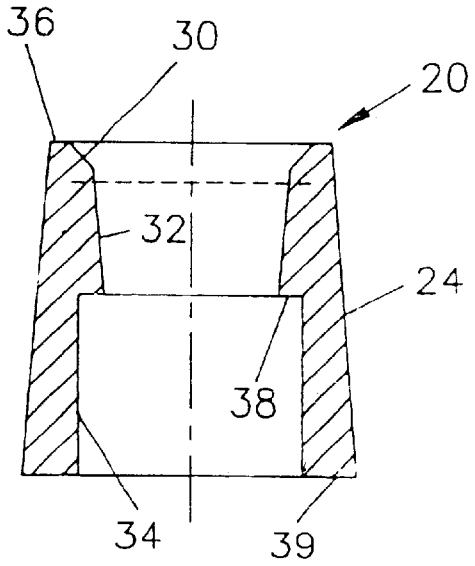
FIGS. 2 and 3 are respectively a cross-sectional elevation and a perspective view of an upper refractory member used in the nozzle of FIG. 1.
Figure 4:
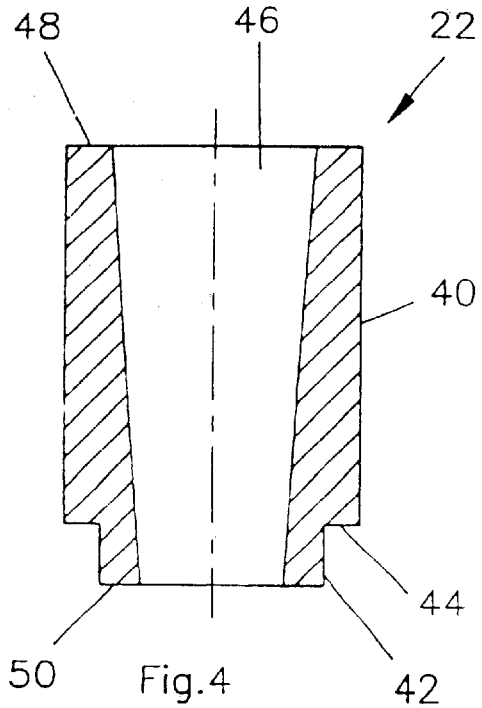
FIGS. 4 and 5 are respectively a cross-sectional elevation and a perspective view of a lower refractory member used in the nozzle of FIG. 1.
Figure 3:
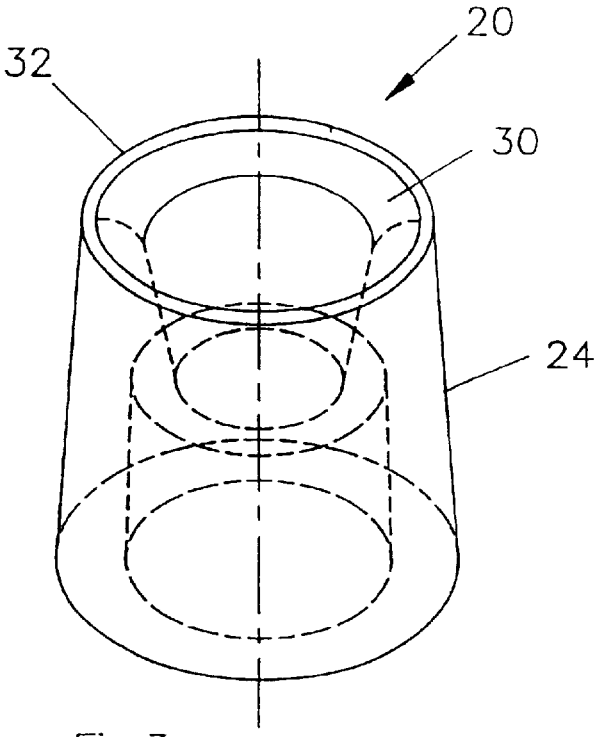
Figure 5:
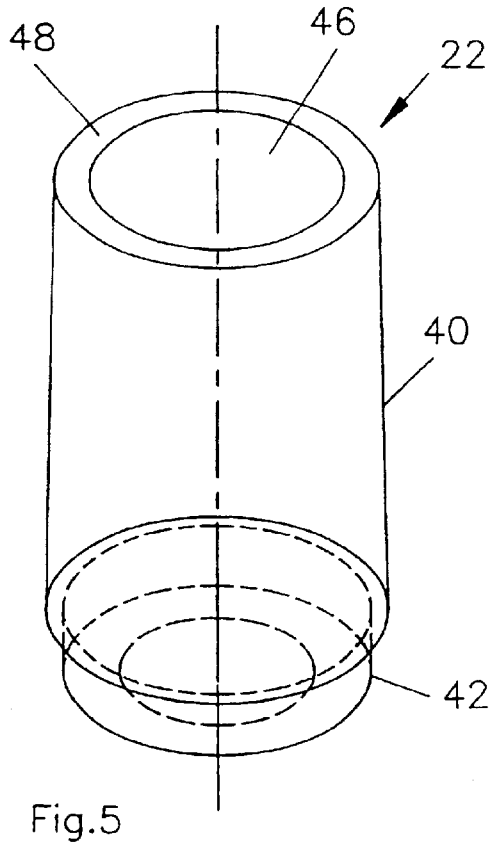

In this embodiment of the present invention, the discharge nozzle comprises upper and lower refractory members 20 and 22 as shown in FIGS. 2 and 3 and FIGS. 4 and 5 respectively. The upper refractory member 20 has an axial length that is greater than the length of the hole 16, and an external surf ace 24 which increases in diameter from top to bottom to match the surface of the hole 16. As seen best in FIG. 2, the member 20 has an axial passage having three sections, namely a mouth 30, a tapered bore 32, and a section 34 of constant diameter.

The mouth 30 acts as a seating area for the stopper 18 and is shaped to provide a smooth transition from the transverse upper end face 36 of the member 20 to the tapered bore 32. The section 34 has a diameter greater than that of the bottom end of the bore 32 and the transition between the two is an annular surface 38. At the bottom of the member 20 is an annular end surface 39.

The lower refractory member 22 has a stepped outer surface in two sections, an upper section 40 of uniform diameter and, at the bottom, a small section 42 of a smaller diameter, the transition between the two sections again being an annular surface or shoulder 44. The member 22 has a tapered bore 46, an upper annular end surface 48, and a lower annular end surface 50.

As seen in FIG. 1, the two refractory members 20 and 22 fit together in the hole 16, the outer surface 24 of the upper member engaging the surface of the hole 16 and the lower member 22 fitting into the constant diameter section 34 of the upper member. A gasket 52 is located between the upper end surface 48 of the lower member 22 and the annular surface 38 of the upper member 20. The tapered bores in the two members are then loined without any transition that would disturb the smooth flow of metal.

On the bottom of the ladle 10 are provided three pillers 56 in a triangular configuration, each of the pillers 56 being rectangular in cross-section and having a slot 58 passing through it, the slots being elongated in the vertical direction. In this embodiment, the surface 60 at the bottom of each slot 56 is inclined across the slot to provide a ramp surface.

A retaining plate 66 extends across the bottom of the ladle and has three holes allowing the three pillers 56 to pass through the plate 66. The plate 66 also has a central hole 68 whose diameter is intermediate that of the outer surfaces of the members 22 and 24 so that the member 24 can pass freely through the hole 68 while an annular area around the periphery of the hole 68 engages the bottom end surface 39 of the upper member 20.

Associated with the retaining plate are wedges (not illustrated) which pass into the slots 58 on the underside of the retaining plate 66 and cooperate with the ramp surfaces 60 to force the upper member 20 securely into position in the hole 16.

The retaining plate 66 is further provided on its bottom surface with a number, in this embodiment two, tapped bosses 78 which engage bolts 80. Between the bottom of the each boss 78 and the head of its associated bolt 80 is a spring 82 surrounded by a shield 84 which acts to protect the thread of the bolt from splatter.

A bottom plate 86 has two countersunk holes, each allowing the shank of a bolt to pass through, but not the spring 82, the shield 84, or the head of the bolt. The heads of the bolts compress the springs against the bottom surface of the plate 86 to retain the plate in position. A central hole 90 in the plate 86 has a diameter intermediate the diameters of the portions 40 and 42 of the lower member 22 so that the end surface 50 of the member 22 is engaged by an annular area surrounding the hole 90.

In use, as the bolts 80 are tightened, the gasket 52 is compressed between the lower and upper members to seal the junction between them. The gasket also ensures that the members do not stick together.

This arrangement allows the lower member 22 to be changed for another member 22 having a larger or smaller exit aperture and therefore a different flow rate. It is to be understood that the taper of the bore of the lower member is always the same as the taper of the bore of the upper member, different exit apertures being achieved by varying the length of the lower member. As the lower member 22 fits into the upper member 20 problems of clearance over static moulds are largely avoided.

It has been found that with a tapered bore through both the upper and lower members the flow rate is less affected by changes in the ferrostatic head, and that the nozzle bore is self cleaning. Other major advantages of the nozzle of the present invention are that the upper and lower members can be made of different materials to suit better their respective operating conditions, and the common problem of deposits on the lower part of the nozzle can be avoided simply by replacing as necessary the lower member 22.

The springs 82 compensate for heat expansion of the bolts, and the shields 84 protect the bolt threads from contamination.

What is claimed is:

1. A refractory nozzle comprising upper and lower members, the upper member having an axial passage comprising a mouth at its top end, a first tapered bore, and an enlarged diameter section at its bottom end and the lower member having a top fitting into the enlarged section, and a second tapered bore extending through the lower member and being tapered throughout its length, a top end of the second tapered bore matching a bottom of the first tapered bore of the upper member.

2. A nozzle as claimed in claim 1, in which a gasket is located between the top end surface of the lower member and the upper member.

3. A nozzle as claimed in claim 1, in which the outer surface of the upper member tapers out from top to bottom.

4. A nozzle as claimed in claim 1, in which the lower member has an external shoulder at its lower end.

5. A bottom pour metallurgical vessel having a hole in its bottom, a nozzle as claimed in claim 1 and means for securing the nozzle in position in the hole.

6. A vessel as claimed in claim 5, in which said means comprises a retaining plate secured to the bottom of the ladle and engaging the bottom of the upper member.

7. A vessel as claimed in claim 6, in which said means includes a bottom plate secured to the retaining plate and engaging the lower member, the distance between the plates being adjustable so that the lower member can be forced into sealing engagement with the upper member.

8. A vessel as claimed in claim 7, in which the bottom plate is secured to the retaining plate by shielded bolts.

9. A vessel as claimed in claim 7, in which the bottom plate engages the external shoulder on the lower member.

10. A nozzle as claimed in claim 1, further comprising a refractory stopper movably located with respect to the mouth of the axial passage for positioning in and between a seated position and an open position.

11. A nozzle as claimed in claim 5, further comprising a refractory stopper movably located with respect to the mouth of the axial passage for positioning in and between a seated position and an open position.

* * * * *